US008231960B2

(12) United States Patent
Shimada et al.

(10) Patent No.: US 8,231,960 B2
(45) Date of Patent: Jul. 31, 2012

(54) DECORATIVE SHEET AND MATERIAL

(75) Inventors: Kenshiro Shimada, Chuo-ku (JP); Joji Suzuki, Chuo-ku (JP); Katsuyuki Ueki, Chuo-ku (JP)

(73) Assignees: Toyo Ink Mfg. Co., Ltd., Tokyo (JP); Toppan Cosmo, Inc., Tokyo (JP)

( * ) Notice: Subject to any disclaimer, the term of this patent is extended or adjusted under 35 U.S.C. 154(b) by 868 days.

(21) Appl. No.: 11/481,817

(22) Filed: Jul. 7, 2006

(65) Prior Publication Data

US 2007/0048505 A1 Mar. 1, 2007

(30) Foreign Application Priority Data

Jul. 8, 2005 (JP) ..... 2005-199569
Jul. 8, 2005 (JP) ..... 2005-199570

(51) Int. Cl.
*B41M 5/00* (2006.01)

(52) U.S. Cl. ..... 428/195.1; 428/201; 428/203; 428/211.1

(58) Field of Classification Search ..... 428/195.1, 428/201, 203, 211.1
See application file for complete search history.

(56) References Cited

U.S. PATENT DOCUMENTS 4,581,423 A * 4/1986 Speranza et al. ..... 525/504
5,271,988 A 12/1993 Ikemoto et al.
5,395,690 A * 3/1995 Kawahata et al. ..... 428/355 N
6,514,624 B2 * 2/2003 Takemoto ..... 428/447
6,558,799 B2 5/2003 Takeuchi et al.
6,852,399 B2 2/2005 Takahashi et al.
2001/0003626 A1 * 6/2001 Syoda et al. ..... 428/520
2004/0137249 A1 * 7/2004 Kamiyama ..... 428/483
2005/0209358 A1 * 9/2005 Miller ..... 522/113

FOREIGN PATENT DOCUMENTS

JP 4-117466 4/1992
JP 2000-334895 12/2000
JP 2004-223994 * 8/2004
JP 2004-292747 10/2004

* cited by examiner

*Primary Examiner* — Gerard Higgins
*Assistant Examiner* — Sathavaram I Reddy
(74) *Attorney, Agent, or Firm* — Oblon, Spivak, McClelland, Maier & Neustadt, L.L.P.

(57) ABSTRACT

The present invention provides a decorative paper which is excellent in solvent resistance, and chemical resistances such as alkali resistance, acid resistance and alcohol resistance without carrying out complicated steps such as an addition of a curing agent into a ink layer because the ink layer which is poor at solvent resistance and chemical resistance is crosslinked. The decorative sheet of the present invention comprises a base material, an ink layer, a curable primer layer containing a curing agent reactive with a resin in the ink layer, and an active energy ray-curable surface protective layer, which are provided in the order of the curable primer layer/ink layer/active energy ray-curable surface protective layer on the base material.

12 Claims, No Drawings

DECORATIVE SHEET AND MATERIAL

BACKGROUND OF THE INVENTION

1. Field of the Invention

The present invention relates to a decorative sheet used for interior materials of construction materials such as furniture and fittings.

2. Disclosure of the Related Art

There has been a proposal on a decorative sheets for various use mentioned above which is prepared by laminating an ink layer and a surface protective layer curable with active energy ray sequentially on a paper base material. In order to obtain decorative paper having resistances to solvents, contamination and chemicals, the thickness of the surface protective layer provided on outermost surface is usually increased. However, when the thickness of the surface protective layer is increased, a coated product of the surface protective layer is severely warped by the hardening shrinkage, giving rise to the problem that it is difficult to handle the coated product and breakdown of the base material is readily caused during coating. As a method solving this problem, there is a proposal that a curing agent is added to an ink layer to cure the ink layer in the publication of Japanese Patent Application No.2003-090149. In this case, however, there is the problem that production efficiency is decreased because the adjustment of the amount of the curing agent is complicated when the color of the ink layer is adjusted, and also the problem that the adhesion of the cured ink layer to the surface protective layer that is curable with active energy ray is deteriorated.

A decorative sheet is required to have a resistance to peeling off by cellophane tape, that is, the property which is resistant to peeling of the surface of the decorative sheet when the applied cellophane tape is peeled off from the decorative sheet. To satisfy this requirement, Japanese Patent Application Laid-Open No. 4-117466 discloses that silicone acrylate is added in a composition of the surface protective layer to control the composition having a viscosity less than a fixed value. The silicone acrylate is thereby made to move easily to the surface, thereby imparting good resistance to cellophane tape peeling.

However, in the case of controlling the mobility of the silicone acrylate by changing the viscosity of the composition, there are problems that the ratio of the mobility varies according to the coating speed, and the amount of an oligomer used to improve the material properties of the composition is limited. Because, the addition of a matting agent sometimes increases the viscosity of the composition when the gloss of the surface protective layer is adjusted, the amount of the matting agent to be added is limited. Accordingly, there is a problem that it is difficult to control the viscosity and glossiness of the composition.

SUMMARY OF THE INVENTION

In view of this situation, there is a demand for decorative paper which is reduced in loads on production processes, has a good printing property and is superior in characteristics required for construction materials. There is also a demand for a decorative sheet which need not control the viscosity of the composition for the surface protective layer, has a good printing property and is superior in characteristics as construction materials, such as resistance to peeling off by cellophane tape.

According to an aspect of the present invention, there is provided a decorative sheet comprising a base material, an ink layer, a curable primer layer containing a curing agent reactive with a resin contained in the ink layer, and an active energy ray-curable surface protective layer, which are provided in the order of the curable primer layer/ink layer/active energy ray-curable surface protective layer on the base material. A curable primer layer or a non-curable primer layer may be further provided between the ink layer and the active energy ray-curable surface protective layer. The ink layer and the curable primer layer may contain are in selected from an acryl resin and a urethane resin which has a carboxyl group and further contains an epoxy resin as a curing agent. The curable primer layer may comprise a compound selected from an active energy ray-curable resin and a monomer having a molecular weight of 1200 or less. The active energy ray-curable surface protective layer may contain a silicone (meth)acrylate and surface-untreated silica. The grammage of the base material may be in a range from 20 to 200 g/m$^2$. The above decorative sheet may be used to form a decorative material.

The lamination of each layer may be carried out at a rate of 100 m/min or more. The above decorative sheet may be a decorative paper.

According to another aspect of the present invention, there is provided an active energy ray-curable surface protective layer comprising a compound selected from an active energy ray-curable oligomer and an active energy ray-curable monomer, a silicone (meth)acrylate and surface-untreated silica. The above monomer may be ethylene oxide-modified trimethylolpropanetriacrylate and may be contained in an amount of 10 to 95% by weight based on the total amount of solids in the composition. The oil absorption of the above surface-untreated silica may be 95 to 250 ml/100 g. The above composition may contain a compound having an amino group.

According to an aspect of the present invention, the ink layer reduced in resistances to solvents and chemicals is crosslinked, making it possible to obtain decorative paper which is superior in solvent resistance and chemical resistances such as alkali resistance, acid resistance and alcohol resistance, without carrying out complicated processes such as addition of a curing agent to the ink layer. According to the aspect of the present invention, it is possible to obtain a decorative sheet prepared by laminating the aqueous ink layer, the curable primer layer and the non-solvent surface protective layer, producing a high effect on the environment protection. Moreover, according to this embodiment, it is possible to obtain a decorative sheet which is produced by integrating the ink layer, the curable primer layer and the surface protective layer with each other and has high adhesion.

Moreover, according to one aspect, it is possible to obtain a decorative sheet superior in cellophane tape peeling resistance, solvent resistance, chemical resistance and resistance to contamination. According to this embodiment of the present invention, the amount of expensive silicone(meth) acrylate is decreased and it is therefore possible to obtain inexpensive and high quality decorative sheet.

The present disclosure relates to subject-matter contained Japanese Patent Application No.2005-199569 filed on Jul. 8, 2006 and Japanese Patent Application No. 2005-199570 filed on Jul. 8, 2006, which are expressly incorporated herein by reference in its entirety.

BEST MODE FOR CARRYING OUT THE INVENTION

The structure of the present invention will be explained.

Examples of the base material in the decorative sheet of the present invention include film base materials and paper base materials.

Examples of the film base material include, though not limited to, film base materials made of polyethylene terephthalate, polypropylene, polyethylene, polyvinyl alcohol or triacetyl acetate. Examples of the paper base material include, though not limited to, paper base materials such as tissue paper, kraft paper, titanium paper, wood free paper, cotton linter paper, baryta paper, parchment paper, Japanese hand made paper and impregnated papers produced by impregnating paper with an acryl resin, polyester resin, polybutadiene resin or the like. Among these paper base materials, decorative raw tissue paper having a grammage of preferably 20 to 200 g/m$^2$ and more preferably 30 to 50 g/m$^2$ is used.

The ink layer of the present invention is formed on the upper surface of the base material and serves a print pattern. Any of oily and aqueous ink compositions may be used for the ink layer without any particular limitation. However, aqueous ink compositions are preferable from the viewpoint of environmental safeguard. The ink composition contains a resin component and a colorant. Moreover, the ink composition may contain additives such as an antifoaming agent and leveling agent, extender pigments and solvents which are added appropriately.

Examples of the resin component include, though not limited to, an acryl resin, urethane resin, polyester resin, cellulose resins such as nitrocellulose, vinyl chloride/vinyl acetate copolymer, shellac, styrenated shellac, casein, styrene/maleic acid resin and rosin/maleic acid resin. In the case of preparing an aqueous ink composition, an aqueous resin is used. Examples of the aqueous resin include water-soluble resins and dispersions of resins such as emulsions and hydrosol types. In the case of using any of these resins, it preferably has a functional group in its main structure. Examples of the functional group include a hydroxyl group, amino group, carboxylic group, mercapto group, aziridinyl group, carbodiimide group, silanol group and alkoxysilyl group. The functional group is not limited to those mentioned above, and any type of functional group may be used insofar as it has reactivity with the curing agent to be added to the primer layer. Among the resin components of the ink composition, a resin having a functional group is preferably contained in an amount of 20 to 99% by weight in terms of solid content ratio and other resin components may have no functional group. When an aqueous ink composition is used, the composition preferably contains an acryl resin or urethane resin having a carboxyl group.

The acid value of the resin is preferably 10 to 300 mg/KOH (in resin solid content) and more preferably 50 to 250 mg/KOH (in resin solid content). When the acid value of the resin is less than 10 mg KOH/g (in resin solid content), the amount of a carboxylic group is small in the case where the resin is reacted with the curing agent, which involves a difficulty in exhibiting resistances to solvents and chemicals. When the acid value of the resin is larger than 300 mg/KOH (in resin solid content), many unreacted acid groups remain when the resin is reacted with the curing agent and there is therefore such a tendency that the resin is made to be scarcely solubilized in water after the resin is cured, which involves a difficulty in exhibiting resistances to contamination. When the acid value is increased, the ratio of components, for example, (meth)acrylic acid and anhydrous maleic acid, which retain acid values in the resin is increased and the ratio of other components for retaining the material properties as construction materials is therefore relatively small, with the result that there is a tendency that the construction material properties to be intended are not obtained even if the resin is reacted with the curing agent. When an acryl resin or urethane resin having a carboxyl group is used to prepare an aqueous ink composition, it is not always necessary to neutralize the carboxyl group into the form of a salt in the water-soluble resin. In resins which must be neutralized for making the resin soluble in water, it is not always necessary to neutralize all acid groups into the form of a salt, but it is preferable to adjust the degree of neutralization, namely, the pH of the resin according to the need. For the neutralization, for example, a known and public amine compound or inorganic alkaline compound such as caustic soda is preferably used.

For the colorant, dyes and pigments are given as examples and known and public ones may be used. For the additives, extender pigments and solvents, known and public ones may also be used.

The primer layer of the present invention is formed over, under or both sides of the ink layer.

A primer layer containing a curing agent having reactivity with the resin contained in the ink layer is called a curable primer layer and a primer layer that does not contain such a curing agent is called a non-curable primer layer. The primer layer (including both the primer layers) prevents the penetration of the components forming the active energy ray-curable surface protective layer into the base material and also imparts adhesiveness between the ink layer and the surface protective layer. When the primer layer is disposed under the ink layer (each layer is formed in the following order: base material/primer layer/ink layer/surface protective layer), the primer layer is not in direct contact with the surface protective layer. However, the surface protective layer which penetrates into the ink layer is in contact with the primer layer and therefore, the adhesion between the ink layer and the surface protective layer is obtained. The curable primer layer imparts curability to the ink layer.

When primer layers are respectively formed on both sides of the ink layer, these primer layers unnecessarily have the same compositions. In this case, the curing agent may be contained in both of the primer layers or in only the primer layer under the ink layer. When the curing agent is contained in both primer layers, the curing agents in both layers may have different compositions without any problem. It is however preferable to dispose the curable primer layer between the base material and the ink layer to improve the adhesion between the ink layer and the base material.

The primer composition contains a resin component. The resin component may contain additives such as an antifoaming agent and leveling agent, extender pigments and solvents and curing agent which are added appropriately.

As the resin component, the same one as the resin used in the above ink layer may be used. As the additives, extender pigments and solvents, known and public ones are used.

An appropriate one is selected as the curing agent according to reactivity with a functional group contained in the resin component used in the primer composition or the ink composition. If the functional group in the resin component contained in the ink composition is, for example, a hydroxyl group or a mercapto group, compounds having an isocyanate group or carboxyl group are preferable as the curing agent. If the functional group is a carboxyl group or an amino group, compounds having an epoxy group or oxazoline group are preferable as the curing agent. Any functional group of the curing agent is not particularly limited, insofar the functional group has a reactivity with a functional group of a resin contained in the ink layer and the primer layer. If the ink composition and the primer composition are aqueous types, compounds having an epoxy group are more preferable, whereas compounds having an isocyanate group are not suitable to these aqueous types because these compounds are deactivated by water. The amount of the curing agent is determined by the number of equivalents of the number of functional groups contained in the curing agent to the number of functional groups contained in the resin. Specifically, the ratio of the number of functional groups contained in the curing agent to the sum of the numbers of functional groups contained in the primer layer and ink layer is preferably 0.01 to 1 equivalent and more preferably 0.1 to 0.5 equivalents. When the ratio is smaller than 0.01 equivalents, the density of crosslinks between functional groups of a resin in the ink composition or primer composition and functional groups in the curing agent is low, giving a difficulty in obtaining the construction properties to be intended. When the amount of the functional group is larger than one equivalent, crosslinks between resin molecules are excessive, resulting in an increase in the stiffness of the ink layer and primer layer. This brings about a deterioration in the adhesion of these layers to the surface protective layer, leading to deteriorated resistance to contamination. There is no particular limitation to the main structure of the curing agent and examples of the main structure include those having a relatively low molecular weight such as pentaerythritol, trimethylolpropane, sorbitol, glycerol, resorcinol, bisphenol, ethylene glycol, polyethylene glycol and methaxylylenediamine. A reactive functional group may be incorporated into a high-molecular weight acryl resin, urethane resin, alkyd resin, polyester resin or the like.

The primer composition preferably contains an active energy ray-curable resin and/or a monomer having a molecular weight of 1200 or less which have an ethylenic unsaturated double bond for the adhesion of the primer layer and the surface protective layer. The resin having an ethylenic unsaturated double bond are those so-called an oligomer and having a molecular weight of 1000 or more. Examples of the resin like this include, though not limited to, urethaneacrylates, polyesteracrylates, acrylacrylates and epoxyacrylates which have a (meth)acrylate group. Among these compounds, urethaneacrylates are preferable because they are expected to provide adhesion and flexibility. Urethaneacrylates having a carboxyl group are more preferable for the purpose of making an aqueous one as the composition.

The monomer having an ethylenic unsaturated double bond further improves the adhesion of the primer layer to the surface protective layer. In the present invention, the primer layer has more difficulty in adhesion to the surface protective layer because it is cured by heating. However, the adhesion can be strengthened by adding the monomer having an ethylenic unsaturated double bond. Examples of such a monomer include monofunctional, difunctional and polyfunctional monomers having a (meth)acrylate group.

Examples of the monofunctional monomer include, though not limited to, 2-(2-ethoxyethoxy)ethylacrylate, stearylacrylate, tetra hydrofurfurylacrylate, laurylacrylate, 2-phenoxyethylacrylate, isodecylacrylate, isooctylacrylate, tridecylacrylate, caprolactoneacrylate, 4-hydroxybutylacrylate, ethoxynonylphenolacrylate, propoxynonylphenolacrylate, phenoxyethylacrylate, phenoxydiethyleneacrylate, ethylene oxide-modified nonylphenylacrylate, methoxytriethylene glycol acrylate, ethylene oxide 2-ethylhexylacrylate, isobornylacrylatedipropylene glycol acrylate and their methacrylate monomers.

Examples of the difunctional monomer include, though not limited to, 1,3-butanedioldiacrylate, 1,4-butanedioldiacrylate, polyethylene glycol diacrylate, polypropylene glycol diacrylate, neopentyl glycol diacrylate, propoxyneopentyl glycol diacrylate, ethoxyneopentyl glycol diacrylate, hydroxypivalic acid neopentyl glycol diacrylate, (hydrogenated) bisphenol A diacrylate, (hydrogenated) ethylene oxide-modified bisphenol A diacrylate, (hydrogenated) propylene glycol-modified bisphenol A diacrylate, 1,6-hexanedioldiacrylate, 2-ethyl 2-butyl-propanedioldiacrylate, 1,9-nonanedioldiacrylate and their methacrylate monomers.

Examples of the polyfunctional monomer include, though not limited to, tris(2-hydroxyethyl) isocyanurate triacrylate, ethoxytrimethylolpropanetriacrylate, propoxytrimethylolpropanetriacrylate, propoxyglyceryl triacrylate, pentaerythritol triacrylate, trimethylolpropaneacrylate, ethylene oxide-modified trimethylolpropaneacrylate, propylene oxide-modified trimethylolpropaneacrylate, tris(acryloxyethyl) isocyanurate, pentaerythritol tetraacrylate, ditrimethylolpropanetetraacrylate, dipentaerythritol hydroxypentaacrylate, ethoxypentaerythritol tetraacrylate, pentaacrylate ester, dipentaerythritol hexaacrylate, ethylene oxide-modified trimethylolpropanetriacrylate, propylene oxide-modified trimethylolpropanetriacrylate, propylene oxide-modified glyceryltriacrylate and their methacrylate monomers.

Among these monomers, those having a molecular weight of, preferably, 1200 or less and more preferably 600 or less are used from the viewpoint of compatibility and functional group equivalent. If the molecular weight is larger than 1200, the number of double bonds is decreased and the contribution of the monomer to adhesiveness is decreased. In the case of preparing an aqueous composition, more preferable examples of the monomer include ethoxytrimethylolpropanetriacrylate having an ethylene glycol main structure (including those having a chain of these main structures) and pentaerythritol triacrylate having a hydroxyl group in its molecule.

The ratio of the monomer in the primer composition is preferably 0.1 to 40% by weight and more preferably 1 to 20% by weight on solid basis. When the ratio is less than 0.1% by weight, the contribution of the monomer to the adhesiveness is not observed whereas when the ratio exceeds 40% by weight, the penetration of the monomer into the base material is easily caused. A ratio out of the above range is therefore undesirable.

The coating amount of the primer layer is 0.1 to 5 $g/m^2$ and preferably 0.5 to 3 $g/m^2$. When the coating amount is less than 0.1 $g/m^2$, unsatisfactory material properties a print pattern layer are obtained whereas when the coating amount exceeds 5 g, the cost of the decorative sheet is raised and therefore, an amount out of the above range is not preferable.

The present invention may be provided with a sealer layer. The sealer layer is disposed between the base material and the ink layer to prevent ink and the surface protective layer from penetrating into the base material, for example, paper. The sealer layer may be disposed with the intention of imparting the adhesiveness of the film base material to the ink layer. For the sealer layer, the same known and public resin, additives, extender pigments and solvent as those used in the ink layer may be used and also may have the same composition as the primer layer. The primer layer may be provided over or under the ink layer, and particularly, a primer layer provided under the ink layer, that is, a primer layer provided between the base material and the ink layer is called a sealer layer. Whether a layer to be formed is a primer layer or a sealer layer is determined according to the material properties to be required. A curing agent may be added in one or two or all of the ink layer, primer layer and sealer layer to make these layers as a two-liquid curable type.

The active energy ray-curable surface protective layer of the present invention imparts abrasive resistance, resistance to contamination, chemical resistance and decorativeness to the surface of the decorative sheet. This protective layer contains one or more monomers or oligomers which have an ethylenic unsaturated double bond which are radically polymerized and cured with energy rays such as ultraviolet rays or electron rays. The protective layer may further contain additives such as a tape release agent, organic/inorganic filler, antifoaming agent and leveling agent, ultraviolet absorber, light stabilizer, antioxidant, fungicide, pigments, dyes and dispersant to the extent that the final properties of a cured film are not adversely affected.

As the monomer or oligomer having an ethylenic unsaturated double bond, those given as the above examples which may be added to the primer layer may be used. There is no particular limitation to the ratio of the monomer and oligomer to be mixed and one or a mixture of these monomers and oligomers are used from the viewpoint of coating viscosity and construction material properties. The amount of the monomer to be added is 1 to 98% by weight based on the total amount of a solid content in the composition. Among these monomers, ethylene oxide-modified trimethylolpropanetriacrylate is particularly preferable from the viewpoint of cellophane tape peeling resistance and cost and is more preferably contained in an amount of 10 to 95% by weight based on the total solid in the composition. As the ethylene oxide-modified trimethylolacrylate, those in which the number of ethylene oxide repeat units (expressed as molar modifications) is 1 to 20 mol are given as examples. Among these examples, those having 3 molar modifications have superior in the properties of the film and are therefore preferable.

Examples of the tape release agent include, though not limited to, silicone type materials and fluorine type materials.

Among these materials, silicone(meth)acrylate is preferable. If silicone(meth)acrylate is used, it imparts excellent cellophane tape peeling resistance to the surface protective layer. As the above silicone(meth)acrylate, known compounds, for example, compounds obtained by introducing a (meth)acryloyl group or the like into the terminal (one terminal or both terminals) or the side chain of a polyorganosiloxane may be used. Examples of these compounds when a (meth)acryloyl group is introduced into the side chain include those having a polyester resin, polyether resin, acryl resin or the like as the resin main structure. As to the molecular weight of the siliconeacrylate, those having a molecular weight of about 250 to 5000 are used. Compounds having a molecular weight of 250 to 2000 are preferable and compounds having a molecular weight of 300 to 2000 are more preferable in consideration of compatibility. The molecular weight is preferably 2000 or less to prevent the cured surface protective layer from becoming cloudy and to obtain the surface protective layer having a smooth surface. The molecular weight is preferably 2000 or less to certainly prevent the silicone(meth)acrylate from floating like an oil on the surface to generate slimes. The amount of silicone(meth)acrylate to be added is preferably 0.1 to 5% by weight in the composition. The amount of silicone(meth)acrylate to be added is preferably 0.05 to 3% by weight and more preferably 0.3 to 1.5% by weight based on the total solid content. When the amount is smaller than 0.05% by weight, the cellophane tape peeling resistance are deteriorated whereas the amount exceeds 3% by weight, slimes are produced on the surface.

The filler is added to regulate the glossiness of the surface protective layer and to impart abrasive resistance to the surface protective layer. Given as examples of the filler are organic fillers and inorganic fillers. Examples of the organic filler include, though not limited to, organic fillers obtained by increasing the molecular weights of an epoxy resin, melamine resin, urea resin, acryl resin, polyimide resin, Teflon resin, polyethylene resin, polyester resin or polyamide resin to a level so high and micronizing these resins so finely that they become insoluble in the solvent to be used. Examples of the inorganic filler include, though not limited to, silica, alumina, talc, magnesium carbonate, calcium carbonate, natural mica, synthetic mica, aluminum hydroxide, precipitated barium sulfate, precipitated barium carbonate, barium titanate and barium sulfate. The above fillers may be used alone or in combinations of two or more. The average particle diameter of the above filler is preferably about 0.5 to 30 μm. When the average particle diameter is too small, only a small matting effect is obtained, whereas when the average particle diameter is too large, the coating surface is roughened, bringing about deteriorated decorativeness. The amount of the organic/inorganic filler to be added is preferably 0.1 to 25% by weight based on the solid content of the resin. When the amount of the filler is smaller than 0.1% by weight, the effect of the addition is not obtained whereas when the amount is larger than 25%, the fluidity of the active energy ray-curable composition is dropped, causing a deteriorated printing property. Among the above fillers, silica is preferable from the viewpoint of matting effect and abrasive resistance.

Silica includes those whose surface is treated such as inorganic treated silica and organic treated silica. In the present invention, surface untreated silica is more preferable.

The surface untreated silica is used to promote the orientation of silicone(meth)acrylate on the surface of silica, thereby imparting more excellent cellophane tape peeling resistance. It is inferred that in the case of surface untreated silica, its surface is constituted of Si—O—, so that silicone (meth)acrylate is adsorbed to silica, and even if the amount of silicone(meth)acrylate is small, it exists on the surface more locally, which betters tape peeling resistance. In the case of using surface untreated silica, a tape release agent is easily orientated on the surface of silica. Therefore, when the tape release agent is silicone acrylate, the amount of siliconeacrylate is preferably in a range from 0.1 to 2.5% by weight.

Generally, silica includes naturally collected silica and synthetic silica. Synthetic silica includes precipitated silica (precipitation method, gel method) and fumed silica (combustion method, arc method) when classified by a production process, and also includes those obtained by treating its surface with organic or inorganic materials such as a silane coupling agent, microcrystalline wax and alumina. Surface untreated silica in the present invention indicates the aforementioned silica which is not surface-treated and is not limited by a difference in production process. Moreover, the particle diameter of the surface untreated silica is preferably 1 to 20 μm. However, the particle diameter of surface untreated silica is appropriately selected according to the film thickness and required glossiness and there is no particular limitation to the particle diameter. Surface untreated silica is preferably those having an oil absorbance of 150 to 250 ml/100 g. When the oil absorbance is less than 95 ml/100 g, the precipitation of silica is significant when it is contained in a coating solution, whereas when the oil absorbance is larger than 250 ml/100 g, the viscosity of the coating solution is too high, making it difficult to print. Silica having a BET specific surface area of 250 to 750 $m^2/g$ is more preferable. If the BET specific surface area is less than 250 $m^2/g$, there is the case where the orientation of silicone(meth)acrylate on the surface of silica is reduced. When the BET specific surface area exceeds 750 $m^2/g$, the distribution of silicone(meth)acrylate oriented on the surface of silica is non dense as a whole. There is therefore the case where it is necessary to add much silicone (meth)acrylate, which is disadvantageous in view of cost. The amount of surface untreated silica is preferably 0.1 to 30% by weight based on the total amount of solids in the composition. When the amount of surface untreated silica is less than 0.1% by weight, there is the case where the effect of the addition is not obtained whereas when the amount exceeds 30% by weight, the viscosity of the coating solution is increased too much and there is therefore the case where coating is difficult. The amount is more preferably 0.5 or more in consideration of cellophane tape peeling resistance and the amount is preferably less than 25% by weight in consideration of the fluidity of the active energy ray-curable composition.

The dispersant is used to suppress a rise in the coating viscosity due to surface treating silica. The dispersant preferably has a main structure having an amino group. Although no particular limitation is imposed on the dispersant, those having a polyester side chain are more preferable. The amine value of the dispersant which expresses the amount of an amino group is preferably 10 to 60 KOH mg/g and the dispersant may contain a carboxyl group at the same time. The amount of the dispersant is 0.1 to 10% by weight and preferably 0.5 to 7% by weight based on the total amount of solids in the composition. When the amount of the dispersant is less than 0.1% by weight, only a small viscosity reducing effect is obtained whereas when the amount exceeds 10% by weight, the degree of crosslinking of the film is decreased, leading to deteriorated material properties of the coating film.

Given as examples of the ultraviolet absorber are organic ultraviolet absorbers and inorganic ultraviolet absorbers. Examples of the organic ultraviolet absorber includes, though not limited to, salicylic acid type ultraviolet absorbers, benzophenone ultraviolet absorbers, benzotriazole ultraviolet absorbers, triazine ultraviolet absorbers and cyanoacrylate ultraviolet absorbers. Examples of the inorganic ultraviolet absorber include, though not limited to, microparticles of zinc oxide, titanium oxide or cerium oxide.

Given as examples of the light stabilizer are HALSs (hindered amine light stabilizers). Examples of the HALS include, though not limited to, bis(1,2,2,6,6-pentamethyl-4-piperidinyl)sebacate, 1-(methyl)-8-(1,2,2,6,6-pentamethyl-4-piperidinyl)sebacate, decane diacid bis(2,2,6,6-tetramethyl-1-(octyloxy)-4-piperidinyl)ester, bis(1,2,2,6,6-pentamethyl-4-piperidinyl)-[[3,5-bis1,1-dimethylethyl]-4-hydroxyphenyl]methyl-butyl malonate and dimethyl-1-(2-hydroxyethyl)-4-hydroxy-2,2,6,6-tetramethylpiperidine succinate polymerization condensate.

Although these ultraviolet absorber and light stabilizer may be added in desired amounts in the composition, they are added preferably in a range from 0.5 to 5% by weight based on the total amount of the composition in view of cost.

Examples of the antioxidant include, though not limited to, a phenol antioxidant, sulfur antioxidant and phosphorous antioxidant.

As the antifoaming agent and the leveling agent, known agents such as a silicone and acryl polymer may be used, and though no particular limitation is imposed on the antifoaming agent and the leveling agent, those having an ethylenic unsaturated double bond are particularly preferable.

Examples of the fungicide include, though not limited to, silver type inorganic compounds, binazine, preventol, thiebendadol, benzimidazole and tiazolylsulfamide compounds.

As the pigment, those usually used may be utilized. Among these pigments, those having high light resistance and weatherability are desirable. Given as examples of the pigment are organic pigments and inorganic pigments. Examples of the organic pigments having high light resistance and weatherability include, though not limited to, a quinacridone type, anthraquinone type, perylene type, perinone type, diketopyrrolopyrrole type, isoindolinone type, condensed azo type, benzimidazolone type, monoazo type, insoluble azo type, naphthol type, flavanthrone type, anthrapyrimidine type, quinophthalone type, pyranthrone type, pyrazolone type, thioindigo type, anthanthrone type, dioxazine type, phthalocyanine type and indanthrone type. Examples of the inorganic pigment like this include, though not limited to, metal complexes such as nickel dioxin yellow and copper azomethine yellow, metal oxides such as titanium oxide, iron oxide and zinc oxide, metal salts such as barium sulfate and calcium carbonate, carbon black, aluminum and mica.

Examples of the dye include, though not limited to, an azo type, quinoline type, stilbene type, thiazole type, indigoid type, anthraquinone type and oxazine type.

The coating amount of the active energy ray-curable composition is 0.5 to 35 $g/m^2$ and preferably 2 to 10 $g/m^2$. When the amount is less than 0.5 g, satisfactory material properties are not obtained whereas when the amount exceeds 35 g, the curling of the decorative paper is remarkable, making it difficult to handle the paper.

Next, a method of producing decorative paper according to the present invention will be explained.

An embodiment of the decorative sheet of the present invention may be one obtained by laminating the following (a) to (c) in this order on a base material.

(a) Curable primer layer/ink layer/active energy ray-curable surface protective layer.

(b) Curable primer layer/ink layer/curable primer layer/active energy ray-curable surface protective layer.

(c) Curable primer layer/ink layer/non-curable primer layer/active energy ray-curable surface protective layer.

Moreover, an embodiment of the sheet of the present invention may be one obtained by laminating the following (d) to (g) on a base material.

(d) Ink layer/surface protective layer.

(e) Ink layer/primer layer/surface protective layer.

(f) Sealer layer/ink layer/surface protective layer.

(g) Sealer layer/ink layer/primer layer/surface protective layer.

Examples of a method of applying the ink layer, primer layer and active energy ray-curable protective layer include, though not limited to, a gravure coating method, gravure offset method, reverse coating method, die coating method, lip coating method, comma coating method, blade coating method, roll coating method, knife coating method, curtain coating method, slot orifice method and spray coating method. Each coating solution may be applied several times or once. The coating solution may be applied using a combination of plural different coating methods.

First, the primer layer is formed on the base material by coating. When the primer layer is formed under the ink layer, it can serve also as a sealer layer. After the coating solution is applied, it is dried under heating at a temperature range from 40° C. to 250° C. Then, the ink layer is formed by coating and dried again under heating. In the case of the above (b) and (c), the primer layer is formed by coating. The ink layer is constituted of any one of patterns such as a solid layer, picture pattern layer and solid layer/picture pattern layer according to the need. There is no particular limitation to the ink layer and an appropriate pattern is selected according to necessary decorativeness. The picture pattern layer may be made to have a repellent function to impart decorativeness by making the surface protective layer exhibit the cissing function to provide decorative characteristics.

Next, the active energy ray-curable surface protective layer is formed by coating. At this time, the surface protective layer may be continuously formed by coating. However, the operation may be terminated once and the protective layer is cured at 20° C. to 80° C. for 24 hours and then formed again. When the coating is carried out after the surface protective layer is cured, the construction material properties of the finished coated product are more improved.

Examples of a method of curing the active energy ray-curable composition include electron ray curing and ultraviolet ray curing. Any of these methods may be used. However, when ultraviolet curing is carried out, a photoinitiator is necessary for curing and the photoinitiator is added in the primer layer and the surface protective layer. Examples of the photoinitiator that is usually used include, though not limited to, an acetophenone type such as diacetoxyacetophenone and 2-hydroxy-2-methyl-1-phenylpropan-1-one, benzoin ether type such as isobutylbenzoin ether and isopropylbenzoin ether, benzyl ketal type such as benzyldimethyl ketal and hydroxycyclohexyl phenyl ketone and ketone type such as benzophenone and 2-chlorothio xanthone. In the case of electron ray-curable type, a photoinitiator is not always necessary.

When electron rays are used to cure, a conventionally known curing device may be used. The quantity of radiation is preferably 10 kGy to 200 kGy and more preferably 30 kGy to 100 kGy. When the quantity of radiation is less than 10 kGy, perfect curing cannot be attained whereas when the quantity of radiation exceeds 200 kGy, the life of an electron ray radiation tube is significantly reduced, which is undesirable from an economical point of view. The acceleration voltage is defined by the thickness and density of the coating film formed on the base material and is usually 50 kv to 250 kv and preferably 75 to 125 kv.

No particular limitation is imposed on the coating speed. However, in the present invention, a higher effect is obtained when the coating speed is 100 m/min or more. When the coating speed is slow, the resin is excessively penetrated, causing disorders such as strike-through. When the coating speed is too high, on the other hand, coating defects are easily caused. Then, if such coating defects exist, such a problem arises that when a test for the material property (solvent resistance) of a construction material is made, a chemical solution is penetrated into these defects, whereby the coating film is easily broken. However, according to the present invention, the coating film is strengthened by curing and therefore no problem arises even if a chemical solution is penetrated and it is therefore possible to obtain excellent construction material properties even if printing is carried out at a high rate.

The decorative material of the present invention is obtained by applying the decorative paper obtained above to a substrate such as a veneer plate and a particle board. The decorative material is used for interior or exterior materials used in houses or office buildings and for furniture. The decorative plate of the present invention has sufficient durability defined in JAS Construction Material.

EXAMPLES

The present invention will be explained in more detail by way of examples, which are not intended to be limiting of the present invention. In the following examples, "%" means "% by weight", "part" means "parts by weight" respectively.

Ink compositions A to C, primer compositions A to F and active energy ray-curable compositions A and B which had the following compositions were prepared.

Ink composition A: Oily ink composition containing 50 parts of nitrocellulose/urethane resin (manufactured by TOYO INK MFG. CO., LTD, solid content: 25%, hydroxyl value: 10 mg KOH/g), 5 parts of pigment and 44 parts of toluene.

Ink composition B: Aqueous ink composition containing 50 parts of an acryl resin (manufactured by TOYO INK MFG. CO., LTD, solid content: 25%, acid value: 150 mg KOH/g), 5 parts of pigment and 44 parts of water.

Ink composition C: Oily ink composition containing 50 parts of an acryl resin (manufactured by TOYO INK MFG. CO., LTD, solid content: 25%, containing neither hydroxyl group nor carboxyl group), 5 parts of pigment and 44 parts of toluene.

Primer composition A: Oily primer composition containing 50 parts of nitrocellulose/urethane resin (manufactured by TOYO INK MFG. CO., LTD, solid content: 25%, hydroxyl value: 15 mg KOH/g) and 13 parts of toluene.

Primer composition B: Oily primer composition obtained by adding 5 parts of a tolylenediisocyanate adduct (Trade name: Coronate L, manufactured by Nippon Polyurethane Industry Co., Ltd.) and 26 parts of toluene to the above oily primer composition.

Primer composition C: Aqueous primer composition containing 50 parts of an acryl emulsion (manufactured by TOYO INK MFG. CO., LTD, solid content: 30%, acid value: 80 mg KOH/g) and 25 parts of water.

Primer composition D: Aqueous primer composition obtained by adding 5 parts of an epoxy resin (manufactured by Nagase Sangyo, epoxy equivalent: 173) and 25 parts of water to the above aqueous primer composition.

Primer composition E: Aqueous primer composition containing 35 parts of an acryl emulsion (manufactured by TOYO INK MFG. CO., LTD, solid content: 30%, acid value: 80 mg KOH/g), 7 parts of a double bond-containing urethaneacrylate emulsion (manufactured by TOYO INK MFG. CO., LTD, solid content: 40%, acid value: 50 mg KOH/g, content of double bonds: 100 mg KOH/g), 2 parts of ethylene oxide-modified trimethylolpropanetriacrylate (molecular weight: 428), 5 parts of an epoxy resin (manufactured by Nagase Sangyo, epoxy equivalent: 173) and 55 parts of water.

Primer composition F: Primer composition obtained by eliminating the epoxy resin from the primer composition E.

Active energy ray-curable composition A: Active energy ray-curable composition containing 20 parts of a urethane-acrylate oligomer (manufactured by Daicel UCB Co., Ltd.), 79 parts of ethylene oxide-modified trimethylolpropanetriacrylate, 1 part of silicone acrylate (molecular 1000) and 10 parts of surface untreated silica (manufactured by Fuji Silysia Chemical Ltd.).

Active energy ray-curable composition B: Active energy ray-curable composition having the same composition as the above active energy ray-curable composition A except that the above surface untreated silica was altered to 10 parts of organically treated silica (manufactured by Fuji Silysia Chemical Ltd.) in the above composition.

Example I-1

A primer composition B was applied to a 30 g/m$^2$ raw thin decorative paper in an amount of 1.5 g/m$^2$ to form a coating film and then the ink composition A was applied to the film by using a gravure coater to form a pattern layer, which was then dried at 120° C. for 10 seconds.

Then, 8 g/m$^2$ of the active energy ray-curable composition A was applied to the surface of the pattern layer and irradiated with electron rays (condition of irradiation: 150 kV, 30 kGy) to cure the surface protective layer, thereby obtaining a thin decorative paper (1). This laminating process was carried out at a running speed of about 150 m/min.

Then, this decorative paper was laminated on a particle board by using a vinyl acetate type adhesive to obtain a decorative plate (1').

Example I-2

A primer composition D was applied to a 30 g/m$^2$ raw thin decorative paper in an amount of 1.5 g/m$^2$ to form a coating film and then the ink composition B was applied to the film by using a gravure coater to form a pattern layer, which was then dried at 170° C. for 10 seconds.

Then, 8 g/m$^2$ of the active energy ray-curable composition A was applied to the surface of the pattern layer and irradiated with electron rays (condition of irradiation: 150 kV, 30 kGy) to cure the surface protective layer, thereby obtaining a thin decorative paper (2). This laminating process was carried out at a running speed of about 150 m/min.

Then, this decorative paper was laminated on a particle board by using a vinyl acetate type adhesive to obtain a decorative plate (2').

Example I-3

A primer composition D was applied to a 30 g/m$^2$ raw thin decorative paper in an amount of 1.5 g/m$^2$ to form a coating film and then the ink composition B was applied to the film by using a gravure coater to form a pattern layer, which was then dried at 170° C. for 10 seconds. The primer composition D was applied to the surface of the patter layer and dried at 170° C. for 30 seconds to form a primer layer having an amount of 2.0 g/m$^2$.

Then, 8 g/m$^2$ Of the active energy ray-curable composition A was applied to the surface of the pattern layer and irradiated with electron rays (condition of irradiation: 150 kV, 30 kGy) to cure the surface protective layer, thereby obtaining a thin decorative paper (3). This laminating process was carried out at a running speed of 150 m/min.

Then, this decorative paper was laminated on a particle board by using a vinyl acetate type adhesive to obtain a decorative plate (3').

Example I-4

A primer composition D was applied to a 30 g/m$^2$ raw thin decorative paper in an amount of 1.0 g/m$^2$ to form a coating film and then the ink composition B was applied to the film by using a gravure coater to form a pattern layer, which was then dried at 170° C. for 10 seconds. The primer composition E was applied again to the surface of the pattern layer and dried at 170° C. for 30 seconds to form a primer layer having an amount of 2.0 g/m$^2$.

Then, 8 g/m$^2$ of the active energy ray-curable composition A was applied to the surface of the pattern layer and irradiated with electron rays (condition of irradiation: 150 kV, 30 kGy) to cure the surface protective layer, thereby obtaining a thin decorative paper (4). This laminating process was carried out at a running speed of about 150 m/min.

Then, this decorative paper was laminated on a particle board by using a vinyl acetate type adhesive to obtain a decorative plate (4').

Example I-5

A primer composition D was applied to a 30 g/m$^2$ raw thin decorative paper in an amount of 1.0 g/m$^2$ to form a coating film and then the ink composition B was applied to the film by using a gravure coater to form a pattern layer, which was then dried at 170° C. for 10 seconds. The primer composition F was applied again to the surface of the patter layer and dried at 170° C. for 30 seconds to form a primer layer having an amount of 2.0 g/m$^2$.

Then, 8 g/m$^2$ Of the active energy ray-curable composition A was applied to the surface of the pattern layer and irradiated with electron rays (condition of irradiation: 150 kV, 30 kGy) to cure the surface protective layer, thereby obtaining a thin decorative paper (5). This laminating process was carried out at a running speed of about 150 m/min.

Then, this decorative paper was laminated on a particle board by using a vinyl acetate type adhesive to obtain a decorative plate (5').

Comparative Example I-1

A primer composition A was applied to a 30 g/m$^2$ raw thin decorative paper in an amount of 1.0 g/m$^2$ to form a coating film and then the ink composition A was applied to the film by using a gravure coater to form a pattern layer, which was then dried at 120° C. for 10 seconds.

Then, 8 g/m$^2$ of the active energy ray-curable composition A was applied to the surface of the pattern layer and irradiated with electron rays (condition of irradiation: 150 kV, 30 kGy) to cure the surface protective layer, thereby obtaining a thin decorative paper (6). This laminating process was carried out at a running speed of about 150 m/min.

Then, this decorative paper was laminated on a particle board by using a vinyl acetate type adhesive to obtain a decorative plate (6').

Comparative Example I-2

A primer composition C was applied to a 30 g/m$^2$ raw thin decorative paper in an amount of 1.0 g/m$^2$ to form a coating film and then the ink composition B was applied to the film by using a gravure coater to form a pattern layer, which was then dried at 170° C. for 10 seconds.

Then, 8 g/m$^2$ of the active energy ray-curable composition A was applied to the surface of the pattern layer and irradiated with electron rays (condition of irradiation: 150 kV, 30 kGy) to cure the surface protective layer, thereby obtaining a thin decorative paper (7). This laminating process was carried out at a running speed of about 150 m/min.

Then, this decorative paper was laminated on a particle board by using a vinyl acetate type adhesive to obtain a decorative plate (7').

Comparative Example I-3

A primer composition D was applied to a 30 g/m$^2$ raw thin decorative paper in an amount of 1.0 g/m$^2$ to form a coating film and then the ink composition C was applied to the film by using a gravure coater to form a pattern layer, which was then dried at 170° C. for 10 seconds.

Then, 8 g/m$^2$ of the active energy ray-curable composition A was applied to the surface of the pattern layer and irradiated with electron rays (condition of irradiation: 150 kV, 30 kGy) to cure the surface protective layer, thereby obtaining a thin decorative paper (8). This laminating process was carried out at a running speed of about 150 m/min.

Then, this decorative paper was laminated on a particle board by using a vinyl acetate type adhesive to obtain a decorative plate (8').

The decorative plates obtained in Examples I-1 to I-5 and Comparative Examples I-1 to I-3 were evaluated by the following items. The results are shown in Table 1.

1. Acid Resistance

Absorbent cotton fully impregnated with an aqueous 10% citric acid solution was placed on the decorative plate, covered with a watch glass and allowed to stand for 18 hours. The surface had been wiped by absorbent cotton before the condition of the surface was observed and was compared with that of the untreated decorative plate. The results of the test were rated on the following basis: A: No change is observed, B: Change is observed.

2. Alkali Resistance

This test was made in the same manner as in the above "1. Test for acid resistance" by using an aqueous 10% ammonia solution as the test solution. The test results were evaluated in the same manner as in the case of the test for acid resistance.

3. Solvent Resistance (i) This test was made in the same manner as in the above "1. Test for acid resistance" using acetone as a test solution. The results of the test were rated on the following basis: A: No change is observed, B: Change is observed a little, C: Change is observed, D: Large change is observed.

(ii) Using methyl ethyl ketone as a test solution, the surface of the decorative plate was rubbed back and force 100 times under a load of 1 kg to observe the surface of the decorative plate after the test was finished. The number of times when peeling was generated is shown.

4. Dying Resistance

Absorbent cotton fully impregnated with violet dye ink (alcohol solvent type) was placed on the decorative plate, covered with a watch glass and allowed to stand for 24 hours. The surface had been wiped by absorbent cotton before the condition of the surface was observed and was compared with that of the untreated decorative plate. The details of the test were the same as those of "1. Test for acid resistance". The results of the test were rated on the following basis: A: No change is observed, B: Microscopic change is observed, C: Change is observed a little, C: Change is observed, D: Large change is observed.

5. Cellophane Tape Peeling Resistance

An operation of applying a 24 mm cellophane tape to the same place of the decorative plate and rapidly removing the tape from the plate was repeated (maximum 10 times), to confirm the number of repetitions when the decorative paper applied to the surface of the decorative plate was broken, to show the number. The cellophane tape means an adhesive tape with an adhesive applied to one surface of a cellophane-type tape.

6. Adhesive

A cross cut was made in the surface of the decorative plate by using a cutter. A 24 mm cellophane tape was applied to the cut position and rapidly removed to confirm the adhesion. The results of the test were rated on the following basis: A: The surface of the decorative plate is not peeled, B: The surface of the decorative plate is peeled a little, C: The surface of the decorative plate is peeled significantly.

7. Abrasive resistance

The surface of the decorative plate was subjected to the 200-times-abrasive test using a Taber's abrasion tester (abrasion wheel: CS-17) to visually observe how the ink layer was exposed. The results of the test were rated on the following basis: A: The case where the surface of the decorative plate is not dyed, B: The case where the surface of the decorative plate is slightly dyed, C: The case where the surface of the decorative plate is dyed significantly.

TABLE 1

| | Acid resistance | Alkali resistance | Solvent resistance 1) | Solvent resistance 2) | Anti-dyeing ability | Cellophane tape peeling resistance | Adhesion | Abrasive resistance |
|---|---|---|---|---|---|---|---|---|
| Example I-1 | A | A | A | 75 | B | 10< | C | B |
| Example I-2 | A | A | A | 65 | A | 10< | C | B |
| Example I-3 | A | A | A | 100< | A | 10< | C | A |
| Example I-4 | A | A | A | 100< | A | 10< | B | A |
| Example I-5 | A | A | A | 100< | A | 10< | A | A |
| Comparative Example I-1 | B | B | D | 40 | E | 10< | C | C |
| Comparative Example I-2 | B | B | D | 32 | E | 10< | C | C |
| Comparative Example I-3 | B | B | D | 60 | E | 10< | C | C |

It is found from Table 1 that the decorative plates of Examples I-1 to I-5 are significantly superior to the decorative plates of Comparative Examples I-1 to I-3 in acid resistance, alkali resistance, solvent resistance, anti-dying characteristics and abrasive resistance. The decorative plates of Examples I-1 to I-5 exhibit satisfactory cellophane tape peeling resistance and adhesiveness.

The present invention will be explained by way of the following examples.

(Production of a Print A)

The following layers were laminated one by one on a base material and dried to obtain a print A. The amount of each layer to be applied was 1.5 g/m$^2$, 5 g/m$^2$ and 1.5 g/m$^2$.

Base material: Tissue paper having a grammage of 30 g/m$^2$.

Sealer layer: Aqueous sealer composition containing 50 parts of an acryl emulsion (manufactured by TOYO INK MFG. CO., LTD, solid content: 30%, acid value: 100 mg KOH/g), 25 parts of water and 5 parts of an epoxy resin.

Ink layer: Aqueous ink composition containing 50 parts of an acryl emulsion (manufactured by TOYO INK MFG. CO., LTD, solid content: 25%, acid value: 150 mg KOH/g), 5 parts of a pigment (for example, titanium oxide) and 44 parts of water.

Primer layer: Aqueous primer composition containing 50 parts of an acryl emulsion (manufactured by TOYO INK MFG. CO., LTD, solid content: 30%, acid value: 80 mg KOH/g) and 25 parts of water.

Next, the compositions Examples II-1 to II-11, Comparative Examples II-1 to II-4) shown in Table 2 were respectively applied to the print A by using a bar coater in an amount of 7 g/m$^2$ and then irradiated with electron rays (condition of irradiation: 150 kV, 30 kGy) to cure the surface protective layer, thereby obtaining a thin paper decorative sheet.

The viscosity of each composition was measured. The results are shown in Table 2. The results of evaluation of the appearance of the coated surface after the coated surface was allowed to stand at ambient temperature for one week are shown in Table 2. The results of the test were rated on the following basis: A: Surface condition is good, B: Non-uniform places are observed.

Here, each component in Table 2 is as follows.

Urethaneacrylate: Hexa-functional urethaneacrylate (trade name: EB220, manufactured by Daicel UCB Co., Ltd.).

TMPTA: Trimethylolpropanetriacrylate (trade name: TMPTA-N, manufactured by Daicel UCB Co., Ltd.)

TMPEOTA: Ethylene oxide-modified trimethylolpropanetriacrylate (trade name: TMPEOTA, manufactured by Daicel UCB Co., Ltd., amount of addition of ethylene oxide: 3 mol)

Silicone(meth)acrylate: One terminal siliconemethacrylate (number average molecular weight: 1000).

Surface untreated silica A: Particle diameter: 6 μm, oil absorbance: 200 ml/100 g.

Surface untreated silica B: Particle diameter: 6 μm, oil absorbance: 350 ml/100 g.

Surface untreated silica C: Particle diameter: 4 μm, oil absorbance: 90 ml/100 g.

Surface treated silica D: Particle diameter: 6 μm, oil absorbance: 200 ml/100 g, microcrystalline treatment.

Dispersant A: Polyester type amino group-containing resin (amine value: 45 KOH mg/g)

The obtained decorative sheet was laminated on a particle board by using a vinyl acetate type adhesive to make a decorative plate. The decorative sheet was evaluated by the following tests 1 to 7. The results are shown in Tables 3 and 4. The test methods and evaluation methods of the tests 1 to 6 are those as described above.

1. Acid resistance
2. Alkali resistance
3. Solvent resistance
4. Anti-dyeing characteristics
5. Cellophane tape peeling resistance
6. Adhesion
7. Decorativeness The uniformity of the coating surface after the surface protective layer was cured was visually observed and the glossiness (60°) was measured.

It is found from the results shown in Tables 2 to 4 that the decorative plates of Examples II-1 to II-5 are superior to those of Comparative Examples II-1 to II-4 in cellophane tape peeling resistance. If ethylene oxide-modified triacrylate is used as a monomer, particularly excellent cellophane tape peeling resistance are obtained. Moreover, when a coating solution contains a dispersant having an amino group, the viscosity of the coating solution is decreased and it is therefore possible to obtain a print that has no pinhole and has excellent decorative characteristics.

TABLE 2

| | Example | | | | | | | | | | | Comparative Example | | | |
|---|---|---|---|---|---|---|---|---|---|---|---|---|---|---|---|
| | II-1 | II-2 | II-3 | II-4 | II-5 | II-6 | II-7 | II-8 | II-9 | 11-10 | II-11 | II-1 | II-2 | II-3 | II-4 |
| Print | A | A | A | A | A | A | A | A | A | A | A | A | A | A | A |
| Urethaneacrylate | 10 | 10 | 10 | 10 | 10 | 10 | 10 | | | 10 | | 10 | 10 | 10 | 10 |
| TMPTA | 79 | | | | | | | 86 | | 74 | | 79 | | | 75 |
| TMPEOTA | | 79 | 79 | 79 | 76 | 64 | 78.5 | | 86 | 5 | 97 | | 89 | 79 | |
| Siliconeacrylate | 1 | 1 | 1 | 1 | 1 | 1 | 1 | 1 | 1 | 1 | 1 | 1 | 1 | 1 | 5 |
| Surface untreated silica A | 10 | 10 | | 10 | 10 | 10 | 10 | 10 | 10 | 10 | 2 | | | | |
| Surface untreated silica B | | | 10 | | | | | | | | | | | | |
| Surface untreated silica C | | | | 10 | | | | | | | | | | | |
| Surface treated silica D | | | | | | | | | | | | 10 | 0 | 10 | 10 |
| Dispersant | | | | | 3 | 15 | 0.5 | 3 | 3 | | | | | | |
| Total | 100 | 100 | 100 | 100 | 100 | 100 | 100 | 100 | 100 | 100 | 100 | 100 | 100 | 100 | 100 |
| Viscosity (mPa · s, 25° C.) | 1500 | 1200 | 2000 | 200 | 250 | 150 | 1000 | 200 | 150 | 1450 | 100 | 1500 | 100 | 1400 | 1500 |
| Appearance of the coated surface after the coated surface was allowed to stand at ambient temperature for one week | A | A | A | B | A | A | A | A | A | A | A | A | A | A | A |

TABLE 3

| | Example | | | | | | | | | | |
|---|---|---|---|---|---|---|---|---|---|---|---|
| | II-1 | II-2 | II-3 | II-4 | II-5 | II-6 | II-7 | II-8 | II-9 | II-10 | II-11 |
| Acid resistance | A | A | A | A | A | A | A | A | A | A | A |
| Alkali resistance | A | A | A | A | A | A | A | A | A | A | A |

TABLE 3-continued

| | Example | | | | | | | | | | |
|---|---|---|---|---|---|---|---|---|---|---|---|
| | II-1 | II-2 | II-3 | II-4 | II-5 | II-6 | II-7 | II-8 | II-9 | II-10 | II-11 |
| Solvent resistance 1) | A | A | A | A | A | C | A | B | B | A | C |
| Solvent resistance 2) | 100< | 100< | 100< | 100< | 95 | 70 | 100< | 100< | 100< | 100< | 30 |
| Anti-dyeing ability | A | A | A | A | A | C | A | A | A | A | A |
| Cellophane tape peeling resistance | 5 | 10< | 10< | 10< | 10< | 8 | 10< | 5 | 10< | 6 | 10< |
| Adhesion | A | A | A | A | A | A | A | A | A | A | A |
| Decorativeness | Printing non-uniformity and pinholes are observed | Printing non-uniformity and pinholes are observed | Printing non-uniformity and pinholes are observed | Uniform surface, pinholes are observed a little. | Uniform surface | Uniform surface | Printing non-uniformity and pinholes are observed | Uniform surface | Uniform surface | Printing non-uniformity and pinholes are observed | Uniform surface, pinholes are observed a little. |
| Glossiness (60°) | 27 | 26 | 24 | 60 | 31 | 33 | 29 | 30 | 30 | 26 | 31 |

TABLE 4

| | Comparative Example | | | |
|---|---|---|---|---|
| | II-1 | II-2 | II-3 | II-4 |
| Acid resistance | A | A | A | A |
| Alkali resistance | A | A | A | A |
| Solvent resistance 1) | A | A | A | A |
| Solvent resistance 2) | 100< | 20 | 100< | 100< |
| Anti-dyeing ability | A | A | A | A |
| Cellophane tape peeling resistance | 1 | 1 | 2 | 1 |
| Adhesion | A | A | A | A |
| Decorativeness | Printing nonuniformity and pinholes are observed | Uniform surface, pinholes are observed a little | Printing nonuniformity and pinholes are observed | Much slime |
| Glossiness (60°) | 27 | 70 | 26 | 26 |

It is further understood by those skilled in the art that the foregoing description is a preferred embodiment of the disclosed invention and that various changes and modifications may be made in the invention without departing from the spirit and scope thereof.

What is claimed is:

1. A decorative sheet comprising:

a base material, an ink layer, a cured primer layer containing a curing agent that has reacted with a resin contained in the ink layer and an active energy ray-curable surface protective layer comprises a silicone (meth)acrylate and surface-untreated silica, which are provided in the order of the cured primer layer/ink layer/active energy ray-curable surface protective layer on the base material, wherein the ink layer comprises an acryl resin having a carboxyl group, and the curing agent of the cured primer layer has an epoxy group.

2. The decorative sheet according to claim 1, further comprising a cured primer layer between the ink layer and the active energy ray-curable surface protective layer.

3. The decorative sheet according to claim 1, further comprising a non-curable primer layer between the ink layer and the active energy ray-curable surface protective layer.

4. The decorative sheet according to claim 1, wherein the cured primer layer is formed from a compound selected from an active energy ray-curable resin and a monomer having a molecular weight of 1200 or less.

5. The decorative sheet according to claim 1, wherein the grammage of the base material is in a range from 20 to 200 $g/m^2$.

6. A decorative material obtainable by using the decorative sheet as claimed in claim 1.

7. A method of producing the decorative sheet as claimed in claim 1, comprising applying the curable primer layer, the ink layer and the active energy ray-curable surface protective layer in this order on the base material at a rate of 100 m/min or more and curing the curable primer layer with heat wherein the curing agent reacts with the resin contained in the ink layer.

8. The decorative sheet according to claim 1, wherein the active energy ray-curable surface protective layer further comprises:

a compound selected from an active energy ray-curable oligomer and an active energy ray-curable monomer.

9. The decorative sheet according to claim 8, wherein the monomer is ethylene oxide-modified trimethylolpropanetriacrylate and is contained in an amount of 10 to 95% by weight based on the total amount of solids in the composition.

10. The decorative sheet according to claim 8, wherein the composition contains a compound having an amino group.

11. The decorative sheet according to claim 1, wherein the base material is paper.

12. The decorative sheet according to claim 1, wherein the active energy ray-curable surface protective layer further comprises ethyleneoxide modified trimethylolpropanetriacrylate, and a compound having an amino group.

* * * * *